US008814070B2

(12) United States Patent
Drozd et al.

(10) Patent No.: US 8,814,070 B2
(45) Date of Patent: Aug. 26, 2014

(54) FINE FINISH AIRLESS SPRAY TIP ASSEMBLY FOR A SPRAY GUN

(75) Inventors: Mitchell M. Drozd, Harwood Heights, IL (US); Paul R. Micheli, Glen Ellen, IL (US); Nekheel S. Gajjar, Chicago, IL (US)

(73) Assignee: Finishing Brands Holdings, Inc., Minneapolis, MN (US)

( * ) Notice: Subject to any disclaimer, the term of this patent is extended or adjusted under 35 U.S.C. 154(b) by 859 days.

(21) Appl. No.: 12/908,642

(22) Filed: Oct. 20, 2010

(65) Prior Publication Data

US 2012/0097765 A1 Apr. 26, 2012

(51) Int. Cl.

| | |
|---|---|
| ***B05B 1/26*** | (2006.01) |
| ***B05B 15/08*** | (2006.01) |
| ***B05B 1/00*** | (2006.01) |
| ***B05B 15/06*** | (2006.01) |
| ***B05B 7/24*** | (2006.01) |
| ***B05B 1/04*** | (2006.01) |
| *B05B 7/08* | (2006.01) |

(52) U.S. Cl.

CPC ..... *B05B 7/2402* (2013.01); *B05B 15/065* (2013.01); *B05B 7/0807* (2013.01); *B05B 15/061* (2013.01); *B05B 1/046* (2013.01)

USPC ..... 239/597; 239/500; 239/587.2; 239/596

(58) Field of Classification Search

USPC ..... 239/290, 296, 402, 427, 427.3, 466, 239/500, 525, 526, 587.2, 597, 596

See application file for complete search history.

(56) References Cited

U.S. PATENT DOCUMENTS

| | | | | |
|---|---|---|---|---|
| 3,784,111 | A * | 1/1974 | Piggott | 239/427.3 |
| 4,128,206 | A * | 12/1978 | Bintner | 239/11 |
| 4,330,086 | A * | 5/1982 | Nysted | 239/8 |
| 4,553,701 | A * | 11/1985 | Rehman et al. | 239/432 |
| 4,655,394 | A * | 4/1987 | Ferrazza et al. | 239/412 |
| 4,776,368 | A | 10/1988 | Drozd | |
| 5,615,836 | A * | 4/1997 | Graef | 239/428.5 |
| 6,561,438 | B1 * | 5/2003 | Restive et al. | 239/428.5 |
| 6,918,546 | B2 * | 7/2005 | Leisi | 239/119 |
| 7,028,916 | B2 | 4/2006 | Micheli | |
| 7,311,271 | B2 | 12/2007 | Micheli | |
| 7,568,635 | B2 | 8/2009 | Micheli | |
| 7,762,476 | B2 | 7/2010 | Micheli | |
| 7,789,327 | B2 | 9/2010 | Micheli et al. | |
| 2004/0031860 | A1 | 2/2004 | Micheli | |
| 2004/0046040 | A1 | 3/2004 | Micheli | |
| 2004/0262416 | A1 | 12/2004 | Micheli | |
| 2005/0006498 | A1 | 1/2005 | Micheli | |
| 2006/0000928 | A1 | 1/2006 | Micheli | |
| 2006/0065760 | A1 | 3/2006 | Micheli | |
| 2006/0214027 | A1 | 9/2006 | Micheli | |
| 2007/0221762 | A1 | 9/2007 | Micheli et al. | |
| 2008/0017734 | A1 | 1/2008 | Micheli et al. | |

(Continued)

*Primary Examiner* — Ryan Reis

(74) *Attorney, Agent, or Firm* — Fletcher Yoder, P.C.

(57) ABSTRACT

The present technique provides a system and method for improving atomization in a spray coating device. An exemplary spray coating device of the present technique has a fine finish tip with an atomization section comprising a first fluid impingement orifice, i.e., a pre-orifice, angled toward an expansion chamber and a subsequent second fluid impingement orifice. The fine finish tip is provided as a unitary assembly that may be applied to a spray gun and that provides a fixed relationship between the pre-orifice, the expansion chamber, and the second orifice, which results in refined spray characteristics, such as uniform particle distribution and uniform fan pattern shapes.

16 Claims, 8 Drawing Sheets

(56) References Cited

U.S. PATENT DOCUMENTS

| | | | |
|---|---|---|---|
| 2008/0048055 | A1 | 2/2008 | Micheli |
| 2008/0185009 | A1 | 8/2008 | Choncholas et al. |
| 2008/0295768 | A1 | 12/2008 | Micheli et al. |
| 2008/0296409 | A1 | 12/2008 | Micheli |
| 2009/0148612 | A1 | 6/2009 | Micheli |
| 2009/0230218 | A1 | 9/2009 | Drozd |
| 2009/0277976 | A1 | 11/2009 | Micheli et al. |
| 2009/0302133 | A1 | 12/2009 | Micheli et al. |
| 2010/0006673 | A1 | 1/2010 | Micheli |
| 2010/0050870 | A1 | 3/2010 | Gajjar et al. |
| 2010/0108784 | A1 | 5/2010 | Drozd et al. |

* cited by examiner

FINE FINISH AIRLESS SPRAY TIP ASSEMBLY FOR A SPRAY GUN

BACKGROUND

The present technique relates generally to spray systems and, more particularly, to industrial spray coating systems. In particular, a system and method is provided for improving atomization in a spray coating device with an atomization tip.

BRIEF DESCRIPTION

This section is intended to introduce the reader to various aspects of art that may be related to various aspects of the present system and techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Spray coating devices are used to apply a spray coating to a wide variety of product types and materials, such as wood and metal. The spray coating fluids used for each different industrial application may have much different fluid characteristics and desired coating properties. For example, wood coating fluids/stains are generally viscous fluids, which may have significant particulate/ligaments throughout the fluid/stain. Existing spray coating devices, such as air atomizing spray guns, are often unable to break up the foregoing particulate/ligaments. The resulting spray coating has an undesirably inconsistent appearance, which may be characterized by mottling and various other inconsistencies in textures, colors, and overall appearance. Accordingly, a technique is needed for improved atomization to provide more consistent spray formations.

BRIEF DESCRIPTION

The present technique provides a system and method for improving atomization in a spray coating device by providing an airless spray tip with improved atomization characteristics. The spray tip provides a unitary structure that may be applied by an operator to a spray gun. The atomization structures are housed within the spray tip in a fixed configuration to allow for more uniform atomization. The resulting spray coating has refined characteristics, such as more uniform particle size and distribution.

DRAWINGS

The foregoing and other advantages and features of the invention will become apparent upon reading the following detailed description and upon reference to the drawings in which.

DETAILED DESCRIPTION

As discussed in detail below, the present technique provides a refined spray for coating and other spray applications by atomizing the fluid prior to distribution onto a surface by passing the fluid through one or more varying geometry passages, which may comprises one or more passageways, e.g., orifices, configured to force the fluid flow from a wider passageway into a narrow orifice. The orifices may be configured in a fixed position relative to one or more expansion chambers that allow the fluid to expand from the narrow orifices. This configuration of alternating narrow passageways and wider passageways provides superior atomization characteristics for spray coating applications.

The alternating narrow and wide passageways may be housed in a single application tip that may be reversibly applied to a spray gun by an operator. In contrast to configurations in which a portion of the atomization passageways may be housed within the spray gun adjacent to a tip application site and a portion of the passageways may be housed within the removable tip so that a misapplication of the tip may change the relationship of these passageways to one another, the present techniques provide a unitary assembly for airless atomization. The unitary assembly provides more consistent atomization because the relationships between the atomization passageways are fixed within the tip and do not shift due to operator error, i.e., an inexpert tip application will not change the relationship of the atomization passageways to one another. The improved atomization as a result allows the spray tip to have a longer useful lifespan and provides superior spray patterns.

Figure 1:
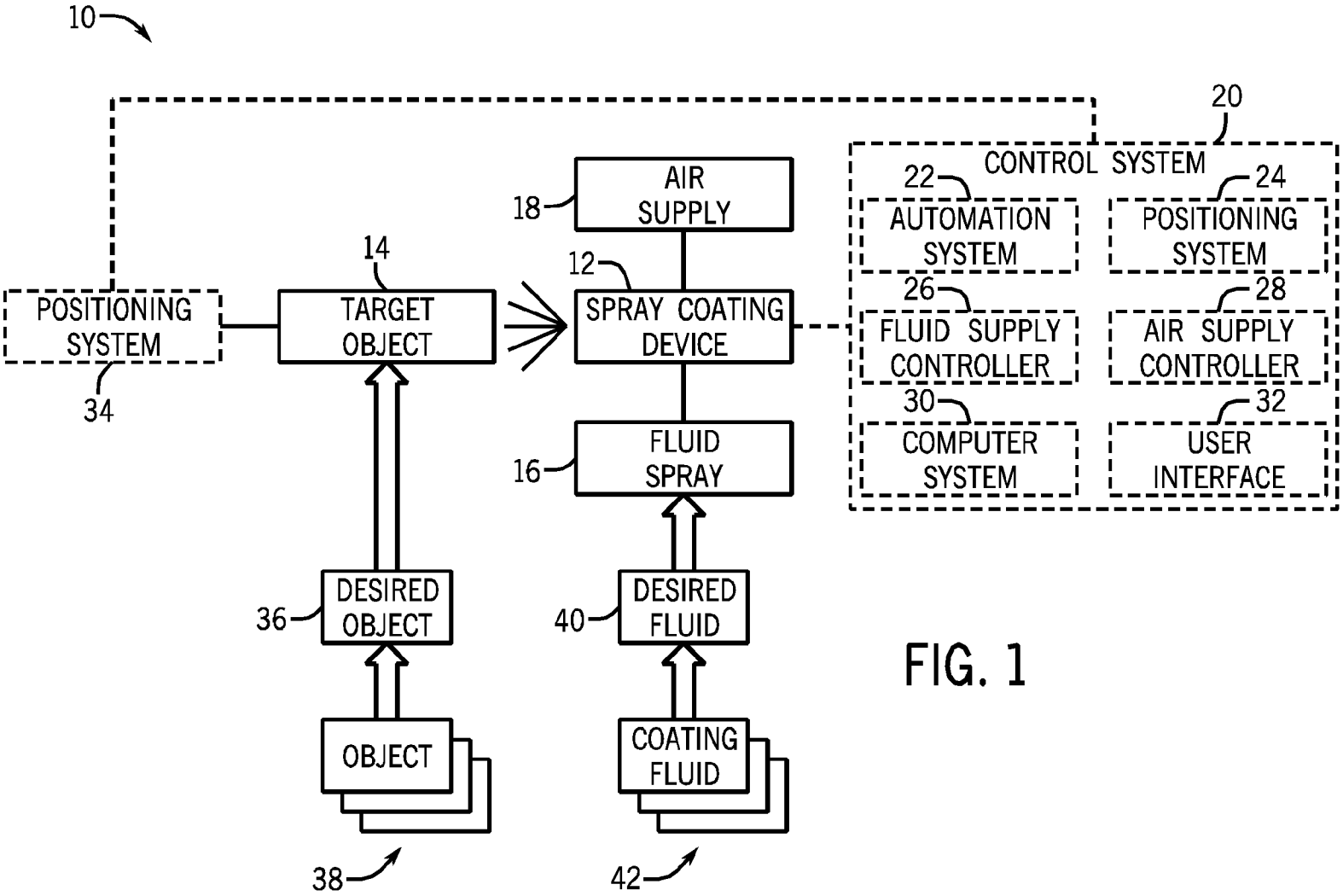
FIG. 1 is a diagram illustrating an exemplary spray coating system of the present technique.

FIG. 1 is a flow chart illustrating an exemplary spray coating system 10, which comprises a spray coating device 12 for applying a desired coating to a target object 14. The spray coating device 12 may be coupled to a variety of supply and control systems, such as a fluid supply 16, an air supply 18, and a control system 20. The control system 20 facilitates control of the fluid and air supplies 16 and 18 and ensures that the spray coating device 12 provides an acceptable quality spray coating on the target object 14. For example, the control system 20 may include an automation system 22, a positioning system 24, a fluid supply controller 26, an air supply controller 28, a computer system 30, and a user interface 32. The control system 20 also may be coupled to a positioning system 34, which facilitates movement of the target object 14 relative to the spray coating device 12. According, the spray coating system 10 may provide a computer-controlled mixture of coating fluid, fluid and air flow rates, and spray pattern. Moreover, the positioning system 34 may include a robotic arm controlled by the control system 20, such that the spray coating device 12 covers the entire surface of the target object 14 in a uniform and efficient manner.

The spray coating system 10 of FIG. 1 is applicable to a wide variety of applications, fluids, target objects, and types/configurations of the spray coating device 12. For example, a user may select a desired fluid 40 from a plurality of different coating fluids 42, which may include different coating types, colors, textures, and characteristics for a variety of materials such as metal and wood. The user also may select a desired object 36 from a variety of different objects 38, such as different material and product types. As discussed in further detail below, the spray coating device 12 also may comprise a variety of different components and spray formation mechanisms to accommodate the target object 14 and fluid supply 16 selected by the user. For example, the spray coating device 12 may be configured to use an air atomizer, a rotary atomizer, an electrostatic atomizer, or any other suitable spray formation mechanism.

Figure 2:
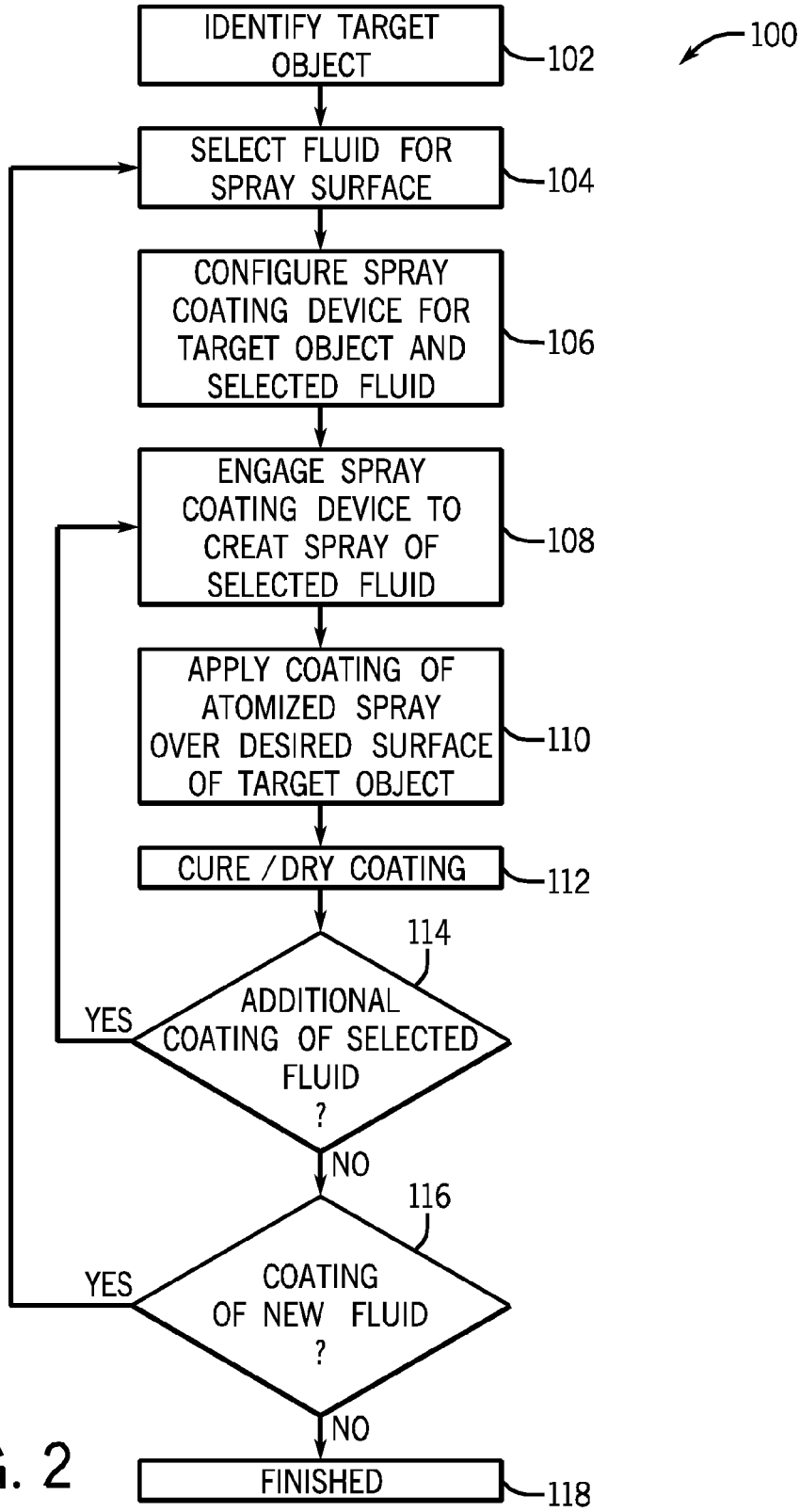
FIG. 2 is a flow chart illustrating an exemplary spray coating process of the present technique.

FIG. 2 is a flow chart of an exemplary spray coating process 100 for applying a desired spray coating to the target object 14. As illustrated, the process 100 proceeds by identifying the target object 14 for application of the desired fluid (block 102). The process 100 then proceeds by selecting the desired fluid 40 for application to a spray surface of the target object 14 (block 104). A user may then proceed to configure the spray coating device 12 for the identified target object 14 and selected fluid 40 (block 106). As the user engages the spray coating device 12, the process 100 then proceeds to create an atomized spray of the selected fluid 40 (block 108). The user may then apply a coating of the atomized spray over the desired surface of the target object 14 (block 110). The process 100 then proceeds to cure/dry the coating applied over the desired surface (block 112). If an additional coating of the selected fluid 40 is desired by the user at query block 114, then the process 100 proceeds through blocks 108, 110, and 112 to provide another coating of the selected fluid 40. If the user does not desire an additional coating of the selected fluid at query block 114, then the process 100 proceeds to query block 116 to determine whether a coating of a new fluid is desired by the user. If the user desires a coating of a new fluid at query block 116, then the process 100 proceeds through blocks 104-114 using a new selected fluid for the spray coating. If the user does not desire a coating of a new fluid at query block 116, then the process 100 is finished at block 118.

Figure 3:
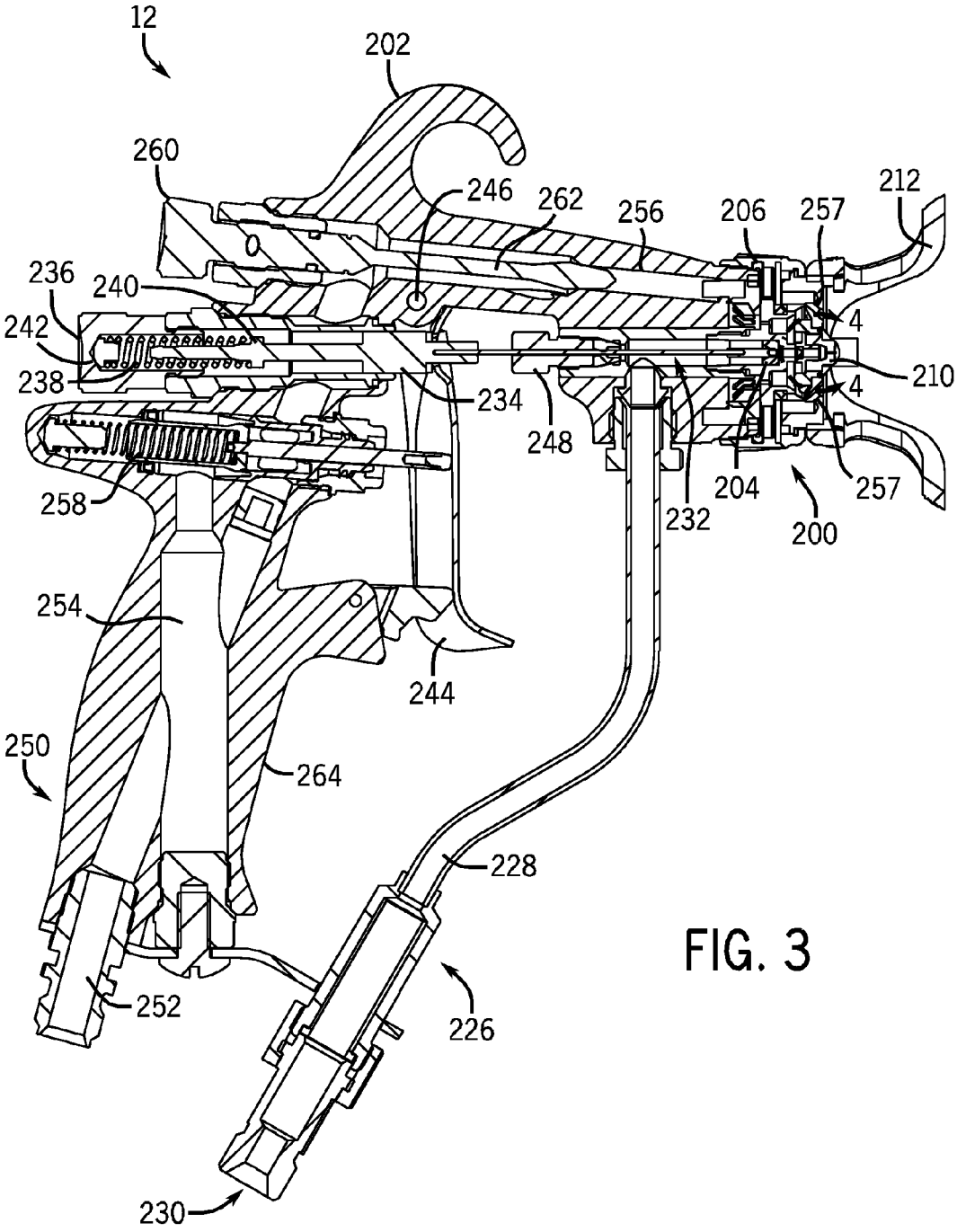
FIG. 3 is a cross-sectional side view of an exemplary spray coating device used in the spray coating system and method of FIGS. 1 and 2.

FIG. 3 is a cross-sectional side view illustrating an exemplary embodiment of the spray coating device 12. As illustrated, the spray coating device 12 comprises a spray tip assembly 200 coupled to a body 202. As discussed in detail below, the spray tip assembly 200 is configured to pre-atomize the liquid (e.g., paint) inside the device 12 prior to a final atomization exiting the device 12. The spray tip assembly 200 includes a fluid delivery tip assembly 204, which may be removably inserted into a receptacle 206 of the body 202. For example, a plurality of different types of spray coating devices may be configured to receive and use the fluid delivery tip assembly 204. The spray tip assembly 200 comprises an airless atomization tip 210, which may be removably secured to the body 202, for example via a retaining nut. The spray tip assembly 200 may also include a finger guard 212 and additional features for shaping the spray.

The body 202 of the spray coating device 12 includes a variety of controls and supply mechanisms for the spray tip assembly 200. As illustrated, the body 202 includes a fluid delivery assembly 226 having a fluid passage 228 extending from a fluid inlet coupling 230 to the fluid delivery tip assembly 204. The fluid delivery assembly 226 also comprises a fluid valve assembly 232 to control fluid flow through the fluid passage 228 and to the fluid delivery tip assembly 204. The illustrated fluid valve assembly 232 has a needle valve 234 extending movably through the body 202 between the fluid delivery tip assembly 204 and a fluid valve adjuster 236. The fluid valve adjuster 236 is rotatably adjustable against a spring 238 disposed between a rear section 240 of the needle valve 234 and an internal portion 242 of the fluid valve adjuster 236. The needle valve 234 is also coupled to a trigger 244, such that the needle valve 234 may be moved inwardly away from the fluid delivery tip assembly 204 as the trigger 244 is rotated counter clockwise about a pivot joint 246. However, any suitable inwardly or outwardly openable valve assembly may be used within the scope of the present technique. The fluid valve assembly 232 also may include a variety of packing and seal assemblies, such as packing assembly 248, disposed between the needle valve 234 and the body 202.

An air supply assembly 250 is also disposed in the body 202 to facilitate atomization at the spray tip assembly 200. The illustrated air supply assembly 250 extends from an air inlet coupling 252. The air supply assembly 250 also includes a variety of seal assemblies, air valve assemblies, and air valve adjusters to maintain and regulate the air pressure and flow through the spray coating device 12. For example, the illustrated air supply assembly 250 includes an air valve assembly 258 coupled to the trigger 244, such that rotation of the trigger 244 about the pivot joint 246 opens the air valve assembly 258 to allow air flow from the air passage 254 to the air passage 256. The air supply assembly 250 also includes an air valve adjustor 260 coupled to a needle 262, such that the needle 262 is movable via rotation of the air valve adjustor 260 to regulate the air flow to the spray tip assembly 200. As illustrated, the trigger 244 is coupled to both the fluid valve assembly 232 and the air valve assembly 258, such that fluid and air simultaneously flow to the spray tip assembly 200 as the trigger 244 is pulled toward a handle 264 of the body 202. Once engaged, the spray coating device 12 produces an atomized spray with a desired spray pattern and droplet distribution. Again, the illustrated spray coating device 12 is only an exemplary device of the present technique. Any suitable type or configuration of a spraying device may be used in conjunction with the airless atomization cap 210 as provided.

Figure 4:
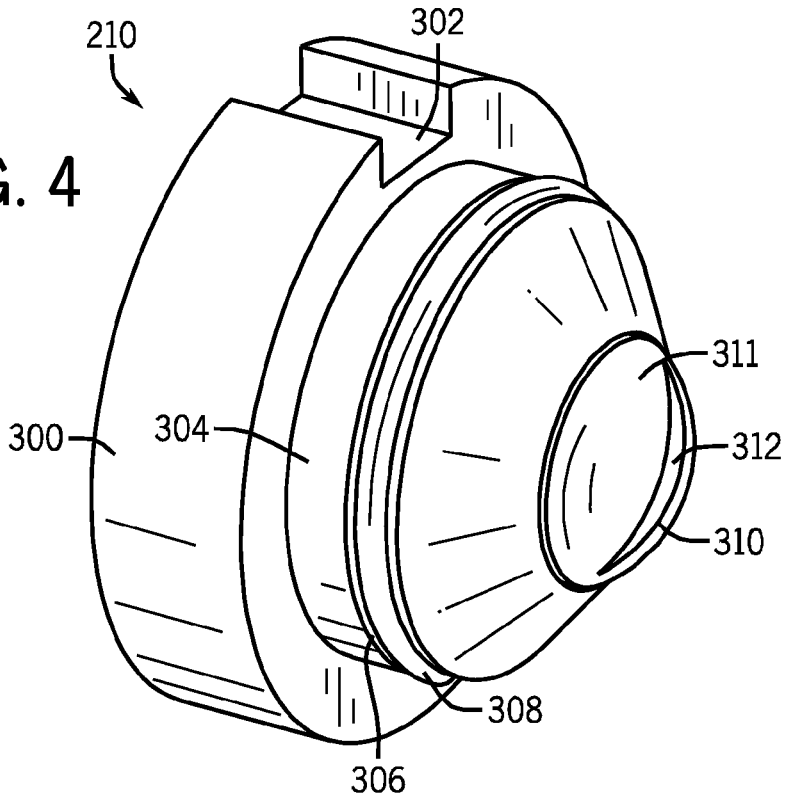
FIG. 4 is a front perspective view of exemplary atomization tip that may be used in conjunction with the spray device of FIG. 3.

FIG. 4 is a front perspective view of the atomization tip 210. The atomization tip 210 may be provided as a separable part from the body 202. In such an embodiment, an operator may select a desired tip (e.g., fine finish, air-assisted), depending on the type of application. For example, in particular embodiments, an operator may desire a softer spray pattern that may be achieved with the atomization tip 210. In addition, the atomization tip 210 may be useful for materials with particular viscosity profiles, such as stains, low viscosity sealers or top sealers, and clear coats, or materials with viscosities in the 14-22 second, zahn 2 range. In addition, the atomization tip 210 may be used to atomize medium to high viscosity materials in the 22-70 second, zahn 2 range, such as lacquers and enamels with 20%-60% solids contents. A Zahn cup is a viscosity measurement device that employs a stainless steel cup of a standard size with a hole drilled in the center of the bottom of the cup. Zahn cups are typically sized from 1-5. To determine the viscosity of a liquid, the cup is dipped and completely filled with the substance. After lifting the cup out of the substance the user measures the time until the liquid streaming out of it breaks up. This is the corresponding "efflux time." On paint standard specifications, one denotes viscosity in this manner: efflux time, Zahn cup number. The pressures used in conjunction with the atomization tip 210 may be in the range of 500-4400 psi, depending on the material.

The atomization tip 210 may include a tip housing 300 and a notch 302 that is configured to mate with a complementary protrusion of the body 202. It should be understood that the housing may include any suitable patterns of cutouts and/or protrusions to assist in mating the atomization tip 210 to the body 202 in the desired orientation. Thus, the notch 302 and associated protrusion may be described as guide features. The atomization tip 210 may also include a core section 304 with an integral channel 306 sized and shaped to accommodate a c-clip spring 308. The tip 210 also includes an ejection port 310 (e.g., a cat-eye ejection port) defining a space 312 through which the atomized fluid spray is ejected from the spray device 12. Accordingly, pressurized fluid from the body 202 transfers into the tip 210 in a direction traveling from the housing 300 to the ejection port 310. Depending on the particular embodiment, the ejection port 310 may be any suitable size or shape, which in turn may produce spray of particular formations. In the illustrated embodiment, the port 310 extends across a curved surface 311 e.g., a semi-spherical or convex surface to define the space 312. For example, a beveled grinding wheel may cut into the curved surface 311 to define the space 312 as a cat-eye shaped opening. In operation, the cat-eye shaped space 312 of the port 310 may form a generally fan-shaped spray.

Figure 5:
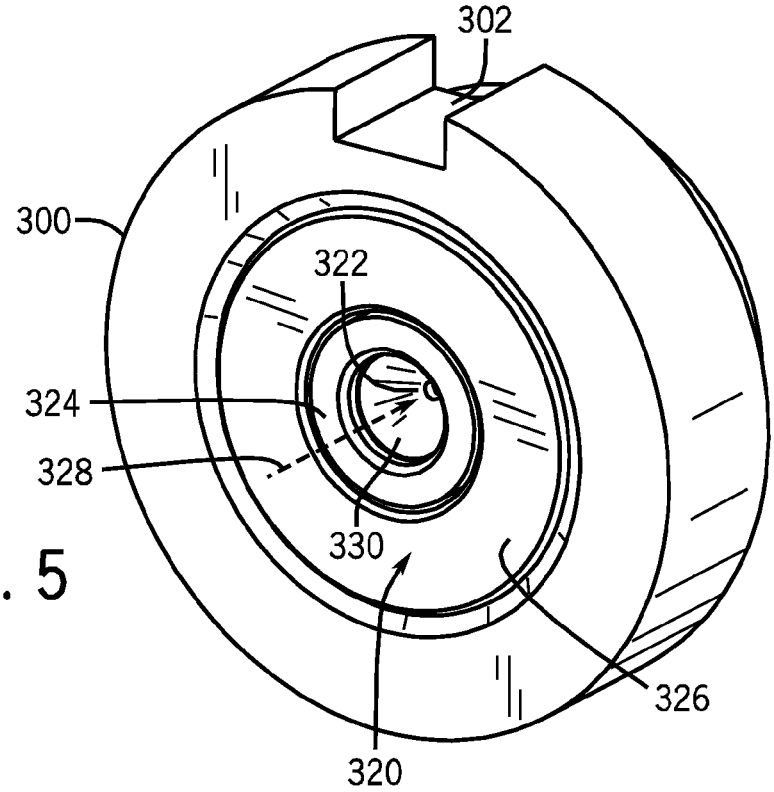
FIG. 5 is a rear perspective view of atomization tip of FIG. 4, further illustrating the pre-orifice section.

FIG. 5 is a rear perspective view of the atomization tip 210 showing the interface surface 320 of the tip 210 with the body 202. The core section 304 includes a bored out section 326 that accommodates a pre-orifice piece 322 and associated mounting component 324 (e.g., alignment spacer). For example, the pre-orifice piece 322 may be press-fit or otherwise coupled to the tip housing 300 to maintain the desired orientation of ports. The pre-orifice piece 322 defines a passageway 330 for fluid flow, shown traveling in an upstream to downstream direction by arrow 328, from the body 202 into the tip 210. The notch 302 may be used to align the tip 210 with the body 202 so that the fluid flow passageway 330 of the tip 210 may be in fluid communication with the fluid delivery passageways of the body 202. When the fluid from the body 202 enters the pre-orifice piece 322, the pre-orifice passageway 330 narrows along the downstream direction 328 of fluid flow. In other words, the pre-orifice passageway 330 converges (e.g., conically) in the downstream direction 328. Eventually, the pre-orifice piece 322 rapidly expands the fluid flow through a pre-atomization orifice upstream from the port 310.

Figure 6:
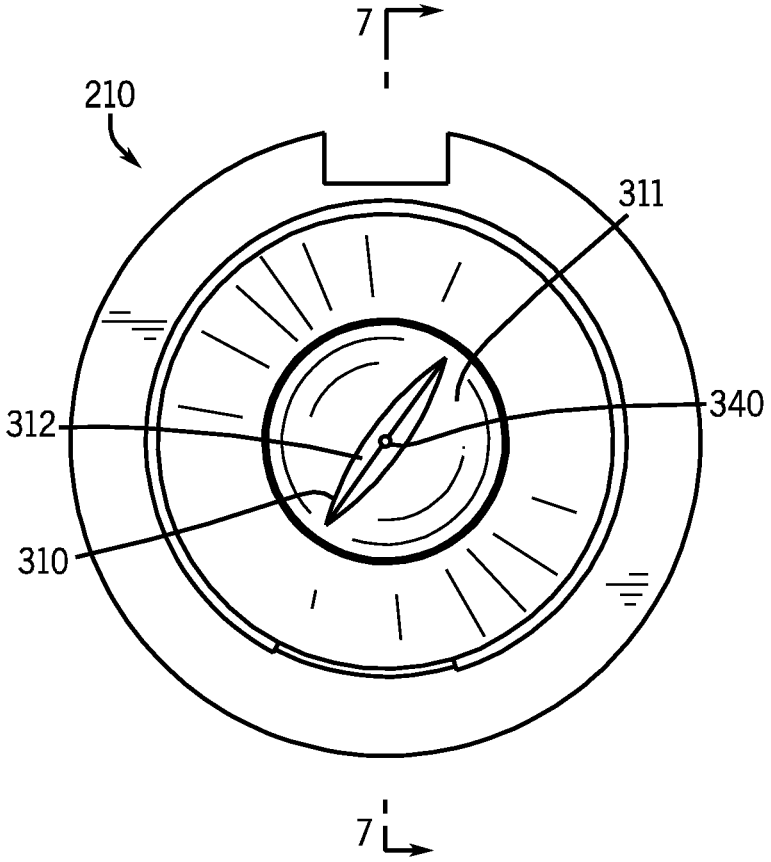
FIG. 6 is a top view of the atomization tip of FIG. 4, further illustrating the ejection port.
Figure 7:
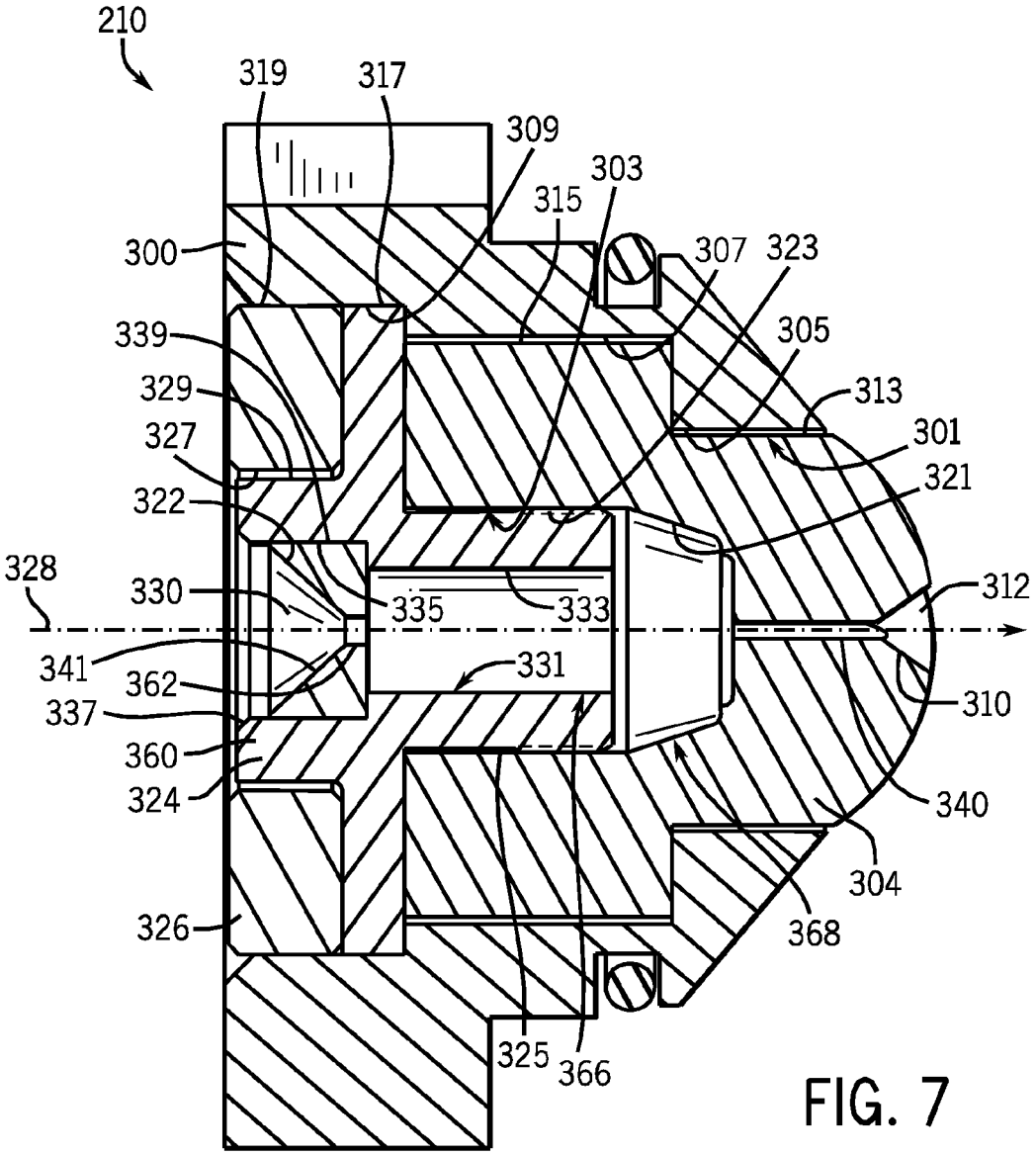
FIG. 7 is a cross-sectional side view of the atomization tip of FIG. 4, illustrating the atomization passageways.

The fluid traverses the tip 210 when the spray device 12 is in operation, and subsequently exits the device 12 through ejection port 310. FIG. 6 is a top view of the tip 210, showing the ejection port 310. Within the port 310 is an ejection orifice 340 that opens into the wider space 312 (e.g., cat-eye shaped space). The relationship between the width of the ejection orifice 340 and the width and/or angle of the space 312 may influence the shape of the spray pattern. In addition, the relationship and shape of additional passageways within the tip 210 define the atomization characteristics. FIG. 7, taken through line 7-7 of FIG. 6, is cross-sectional view of the tip 210 in which the fluid atomization passageways are shown.

As illustrated in FIG. 7, the atomization tip 210 includes the housing 300 and other mounting components that may be assembled to configure the passageways with the appropriate relationships to one another. For example, the housing 300, the core section 304, the mounting components 324, and the bored out section 326 may be arranged relative to one another and to a central bore section 360 to fix the geometrical interrelationship between the pre-orifice passageway 330 and the ejection port 310. As illustrated, the core section 304 fits inside a bore 301 of the housing 300, the mounting component 324 fits inside a bore 303 of the core section 304 and the bore 301 of the housing 300, and the bored out section 326 fits within the bore 301 of the housing 300. The bore 301 has a plurality of differently-sized bore portions 305, 307, and 309, each progressively larger in diameter. Each of these bore portions 305, 307, and 309 is cylindrical to match cylindrical exterior portions 313, 315, 317, and 319 of the core section 304, the mounting component 324, and the cored out section 326. Likewise, the bore 303 has a plurality of differently-sized bore portions 321 and 323, each progressively larger in diameter. The bore portion 321 is conical or tapered in a diverging angle toward the ejection port 310, while the bore portion 323 has a cylindrical shape to match a cylindrical exterior portion 325 of the mounting component 324. The bored out section 326 also includes a bore 327, e.g., a cylindrical bore, that fits about a cylindrical anterior portion 329 of the mounting component 324 interfaces with the housing 300, the core section 304, and the bored out section 328 via the cylindrical exterior portions 325, 317, and 328 to facilitate alignment.

The mounting component 324 also facilitates alignment with the pre-orifice piece 322. For example, the mounting component 324 includes a bore 331 with cylindrical bore portions 333 and 335 and a conical or beveled bore portion 337. The cylindrical bore portion 335 fits about a cylindrical exterior portion 339 of the pre-orifice piece 322. For example, the pre-orifice piece 322 may be press-fit into the mounting component 324. In the illustrated embodiment, the mounting component 324 includes cylindrical portion 317 that axially abuts an axial end face of the core section 304. The abutments of the mounting component 324 and the core section 304 at least in part define the geometries of the expansion chambers 366 and 368 and the orifices 362 and 340. Likewise, the components 300, 304, 322, 324, and 326 may be press-fit together. In other embodiments, the components 300, 304, 322, 324, and 326 maybe fit snuggly together and compressed between the housing 300 and the body of the spray device 12. As appreciated, the geometries of the components 300, 304, 322, 324, and 326 facilitate alignment of the passages through these components. In particular, the mounting component 324 aligns the passage 330 of the pre-orifice piece 322 with the port 310 of the core section 304. In addition, the mounting component 324 aligns the orifice 362, the expansion chambers 366 and 368, and the orifice 340 along the axis 328. Accordingly, the orifice 362 and the orifice 340 are aligned along the same axis. The mounting component 324 also at least in part defines the expansion chamber 366, e.g., defines geometric properties, such as length of the expansion chamber 366, while core section 304 at least in part defines expansion chamber 368.

As illustrated in FIG. 7, the central bore section 360 is defined by the passage 330 of the pre-orifice section 322, the cylindrical bore portion 333 of the mounting component 324, the conical bore portion 321 of the core section 304, the ejection orifice 340 of the core section 304, and the space 312 of the port 310 of the core section 304. The passage 330 of the pre-orifice section 322 includes a converging section 341 (e.g., conical passage) leading to a narrow cylindrical orifice 362 (e.g., a first liquid atomization orifice along the flow path). In turn, the orifice 362, which may be defined as an internal pre-atomization orifice, abruptly dumps the fluid flow into the cylindrical bore portion 333. Thus, the fluid flow undergoes a sudden expansion from the orifice 362 to the cylindrical bore portion 333, which may be defined as a first expansion chamber 366. In turn, the cylindrical bore portion 333 abruptly dumps the fluid flow into the conical bore portion 321. Again, this abrupt increase in diameter causes a sudden expansion of the fluid flow in the expansion chamber 368. As this point, the fluid flow is forced into the orifice 340 (e.g., the second liquid atomization orifice along the flow path), which is substantially smaller in diameter than the conical bore portion 321. Eventually, the orifice 340 ejects the fluid flow through the cat-eye space 312 of the port 310. Again, the unique coaxial arrangement of the components 300, 304, 322, 324, and 326 one inside another facilitates alignment of the various passages to improve preatomization with the pre-orifice section 322 and expansion chamber 366 and 368 and subsequent atomization with the port 310.

Figure 8:
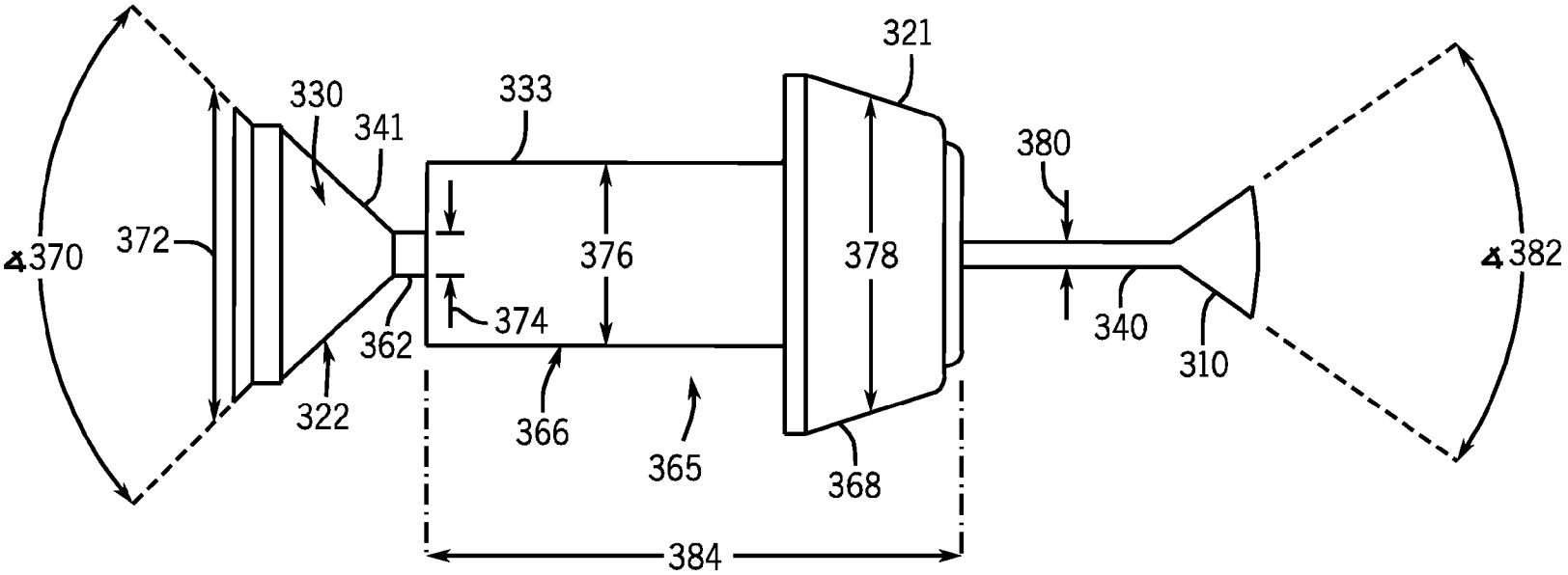
FIG. 8 is detail view of the atomization passageways of FIG. 7.

The fluid atomization passageways are shown in detailed view in FIG. 8. In particular, the dimensions and angles of the passageways influence the characteristics of the atomization. It should be understood that the following dimensions are provided as examples, and that one with skill in the art may alter the characteristics of the passageways to achieve desired spray pattern formations. Further, the dimensions may be scaled or multiplied to accommodate tips and/or spray devices of different sizes. Fluid exiting the body 202 enters the pre-orifice passageway 330, which includes the converging section 341 with an angle 370. The degree of the angle 370 may, in certain embodiments, be between about 80 degrees and about 90 degrees, between about 83 degrees and about 87 degrees, or may be about 85 degrees. In other embodiments, the angle 370 may be between about 40 degrees and about 140 degrees. In other embodiments, the angle 370 may be any suitable angle for narrowing a typical fluid flow passageway, on a spray device body 202 to an orifice diameter 374 of between about 0.010 inches and about 0.020 inches. The expansion chamber 366 (e.g., bore portion 333) may be a passageway between about 0.07 inches and 0.1 inches, or, in a specific embodiment, may be about 0.085 inches. The size of the expansion chamber 366 may generally match the widest diameter 372 of the pre-orifice 322. It should be understood that the diameter of any of the fluid passageways may be measured at any section substantially orthogonal to fluid flow axis 328.

After exiting the orifice 362, the fluid may expand into expansion chamber 366. Expansion chamber 366 has a diameter 376 wider than the orifice 362. The diameter 376 may be at least 1.5 times or at least 3 times the diameter 374 of the orifice 362. In the illustrated embodiment the expansion chamber 366 leads to the second expansion chamber 368, which has a diameter 378 greater than the diameter 376. For example, the diameter 378 may be at least 1.5 to 3 times the diameter 376. The illustrated chamber 366 has the cylidrical bore portion 333 whereas the chamber 368 has the conical bore portion 321. Thus, the chamber 368 has a diameter 378 that is greater at an upstream portion and smaller at a downstream portion. In addition, the length 384 of the combined expansion chamber 365, defined by chambers 366 and 368, may influence the atomization quality. In one embodiment, the expansion chamber 365 is about 0.170 inches to about 0.190 inches in length 384. In another embodiment, the expansion chamber 365 is at least as long as 10 times the diameter 374 of the orifice 362.

After expansion, the atomized fluid enters a second orifice, e.g., ejection orifice 340. The relationship of the diameter 374 of the first orifice 362 and diameter 380 of the second orifice 340 may also influence the spray characteristics. In one embodiment, the diameters 374 and 380 are about equal. In another embodiment, the diameter 380 is larger than the diameter 374, for example at least about 0.001 inches larger. For example, the diameter 380 may be approximately 0.05 to 20 percent, 1 to 10 percent, or 1 to 5 percent greater than the diameter 374. Further, in particular embodiments, the diameter 374 may be about 0.011 inches, 0.013 inches, 0.015 inches, 0.017 inches, or 0.019 inches, while the diameter 380 may be about 0.012 inches, 0.014 inches, 0.016 inches, 0.018 inches, or 0.020 inches. In particular, larger orifice sizes may be more suitable for more viscous fluids, while smaller orifice sizes may be better suited to less viscous fluids. The atomized spray in the ejection orifice 340 is then ejected into the ejection port 310, which may also be associated with particular passageway angles 382 that influence the spray pattern. For example, smaller angles 382 may be associated with a more concentrated, smaller, spray formation while larger angles 382 may be associated with a more diffuse, larger, spray formation. The particular characteristics of the spray formation may be selected by a user.

Figure 9:
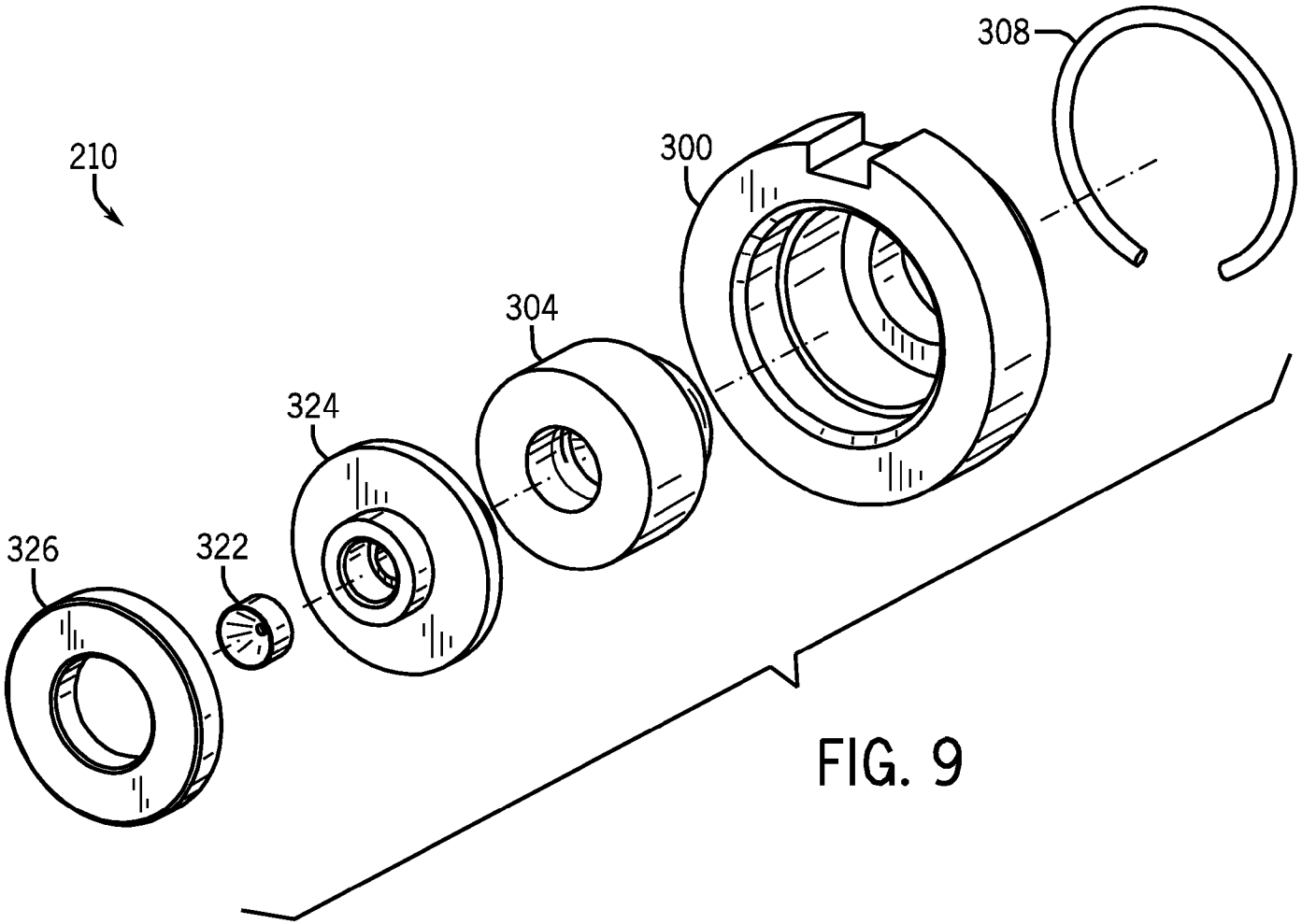
FIG. 9 is an exploded side view of the atomization tip of FIG. 4.

As noted, the characteristics of the atomization are determined by the relationship between the passageways of the atomization tip 210. Accordingly, the tip 210 may be formed with suitable materials and by any suitable method to establish the desired relationships and hold the passageways at a fixed distance during use of the spray device 12. FIG. 9 is an exploded view of an exemplary tip 210. The housing 300, core portion 304, mounting component 324 and bored out section 326 may be formed from suitably wear resistant materials, such as tungsten carbide. The pre-orifice piece 322 may be formed of sapphire material, and mounting component 324 may be formed from nylon. The component parts of the atomization tip 210 may be press-fitted, interference-fitted, fastened together with additional fastening components, threaded together, or and/or adhered or heat-fastened to one another and clamped with c-spring 308. For example, the pre-orifice piece 322 may be press-fit into the mounting component 324.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A spray system, comprising:

a fluid spray tip assembly, comprising:

a first structure having a first liquid atomization orifice positioned at a terminating end, wherein the first structure forms part of and defines a passage configured to narrow a liquid flow towards the first liquid atomization orifice;

a second structure comprising a first bore portion and a tapered second bore portion coupled to a channel terminating in a second liquid atomization orifice, wherein the first structure is mounted inside of the second structure, the second liquid atomization orifice is disposed along a liquid flow path downstream from the first liquid atomization orifice;

an expansion chamber disposed along the liquid flow path between the first and second liquid atomization orifices, wherein the expansion chamber comprises a first expansion chamber disposed within the first bore portion and a second expansion chamber formed by the tapered second bore portion that is wider than the first expansion chamber and that is coupled to the first expansion chamber such that the second expansion chamber directly receives the liquid flow from the first expansion chamber; and a housing that houses the first structure and the second structure, wherein the housing comprises a bore that the first and second structures are positioned within.

2. The system of claim 1, comprising an alignment spacer disposed between the first structure and the second structure, wherein the alignment spacer aligns the first and second liquid atomization orifices relative to one another.

3. The system of claim 2, wherein the alignment spacer aligns a first axis of the first liquid atomization orifice with a second axis of the second liquid atomization orifice.

4. The system of claim 2, wherein the alignment spacer at least partially defines an axial length of the expansion chamber between the first and second structures.

5. The system of claim 2, wherein the alignment spacer comprises a third bore supporting the first structure and a fourth bore at least partially defining the expansion chamber, wherein the fourth bore is downstream from the third bore, and the first liquid atomization orifice has a smaller diameter than the fourth bore.

6. The system of claim 5, wherein the alignment spacer extends partially into the first bore portion of the second structure, the fourth bore defines the first expansion chamber, and an innermost portion of the tapered second bore portion of the second structure defines the second expansion chamber.

7. The system of claim 1, wherein the second expansion chamber converges toward the second liquid atomization orifice.

8. The system of claim 6, wherein the alignment spacer comprises a flange portion coupled to a protruding portion, the protruding portion extends partially into the first bore portion of the second structure, and the flange portion axially abuts an axial end face of the second structure adjacent the first bore portion.

9. The system of claim 1, wherein the first structure is tungsten carbide and the alignment spacer is nylon.

10. The system of claim 1, wherein the first structure is press-fit into the alignment spacer.

11. The system of claim 1, wherein the second liquid atomization orifice has a larger diameter than the first liquid atomization orifice.

12. A spray system, comprising:

a fluid spray tip assembly, comprising:

a first structure having a first liquid atomization orifice, wherein the first structure forms part of and defines a passage configured to narrow a liquid flow towards the first liquid atomization orifice;

a second structure having a second liquid atomization orifice;

an alignment spacer that aligns and spaces the first liquid atomization orifice relative to the second liquid atomization orifice, wherein the alignment spacer comprises a first bore and a second bore, the first bore having a wider inner diameter than the second bore such that the first structure does not advance beyond the first bore, and wherein the first liquid atomization orifice terminates at an end of the second bore, and a housing that houses the first structure, the second structure, and the alignment spacer, wherein the first structure extends into the first bore of the alignment spacer, the alignment spacer extends into a third bore of the second structure, and the second structure extends into a fourth bore of the housing.

13. The system of claim 12, comprising an expansion chamber between the first and second liquid atomization orifices, wherein the second liquid atomization orifice has a larger diameter than the first liquid atomization orifice, and the expansion chamber has a larger diameter than the first and second liquid atomization orifices.

14. The system of claim 12, wherein the first structure does not directly contact the second structure.

15. The system of claim 12, wherein the first bore and the second bore of the alignment spacer form a step that abuts a lower surface of the first structure.

16. The system of claim 12, wherein the alignment spacer comprises a flange, wherein the flange abuts an axial face of the second structure and is wider than the second structure.

* * * * *